US011084308B2

(12) United States Patent
Horn et al.

(10) Patent No.: US 11,084,308 B2
(45) Date of Patent: Aug. 10, 2021

(54) HEAT-SENSITIVE RECORDING MATERIAL

(71) Applicant: PAPIERFABRIK AUGUST KOEHLER SE, Oberkirch (DE)

(72) Inventors: Michael Horn, Offenburg (DE); Jurgen Keske, Neuried (DE); Dietmar Fritz, Oberkirch (DE)

(73) Assignee: PAPIERFABRIK AUGUST KOEHLER SE, Oberkirch (DE)

( * ) Notice: Subject to any disclaimer, the term of this patent is extended or adjusted under 35 U.S.C. 154(b) by 140 days.

(21) Appl. No.: 15/775,207

(22) PCT Filed: Nov. 9, 2016

(86) PCT No.: PCT/EP2016/077088
§ 371 (c)(1),
(2) Date: May 10, 2018

(87) PCT Pub. No.: WO2017/081064
PCT Pub. Date: May 18, 2017

(65) Prior Publication Data

US 2018/0370267 A1 Dec. 27, 2018

(30) Foreign Application Priority Data

Nov. 11, 2015 (DE) ..... 10 2015 119 428.7

(51) Int. Cl.
*B41M 5/333* (2006.01)
*B41M 5/337* (2006.01)
*B41M 5/327* (2006.01)

(52) U.S. Cl.
CPC ..... *B41M 5/3335* (2013.01); *B41M 5/3275* (2013.01); *B41M 5/3333* (2013.01); *B41M 5/3375* (2013.01); *B41M 5/3377* (2013.01); *B41M 2205/04* (2013.01)

(58) Field of Classification Search
CPC ..... B41M 5/3275; B41M 5/3333; B41M 5/3335; B41M 5/3377
See application file for complete search history.

(56) References Cited

U.S. PATENT DOCUMENTS 4,996,113 A 2/1991 Otani et al.
6,746,718 B2 6/2004 Yokota
7,192,904 B2 * 3/2007 Iwasaki ..... B41M 5/3333 427/150
7,935,656 B2 * 5/2011 Elmasry ..... B41M 5/3372 427/150
9,931,877 B2 4/2018 Stork et al.

FOREIGN PATENT DOCUMENTS

| | | | |
|---|---|---|---|
| DE | 1019605 | T1 | 2/2003 |
| EP | 1 382 459 | A1 | 1/2004 |
| EP | 2910384 | B1 | 8/2015 |
| EP | 2 910 384 | B1 | 9/2016 |
| JP | 57-176196 | A | 10/1982 |
| JP | 59-022795 | A | 2/1984 |
| JP | 60-032697 | | 2/1985 |
| JP | 62-261479 | A | 11/1987 |
| JP | 04-062088 | A | 2/1992 |
| JP | 4-307290 | A | 10/1992 |
| JP | 06-155908 | A | 3/1994 |
| JP | H08132738 | A | 5/1996 |
| JP | 2003182231 | A | 7/2003 |
| JP | 3495138 | B2 | 2/2004 |
| JP | 2004160997 | A | 6/2004 |
| JP | 2005-088458 | A | 4/2005 |
| JP | 2014151611 | A | 8/2014 |

OTHER PUBLICATIONS

English Translation of Office Action for Japanese Application No. 2018-523438, dated Dec. 17, 2020, 10 pages.

* cited by examiner

*Primary Examiner* — Gerard Higgins
(74) *Attorney, Agent, or Firm* — Fay Sharpe LLP

(57) ABSTRACT

The invention relates to a heat-sensitive recording material, comprising a carrier substrate and at least one heat-sensitive thermal reaction layer, which is applied to at least one side of the carrier substrate and contains at least one fluoran color former, at least one color developer, at least one melting aid, and optionally typical additives, such as lubricants, stabilizers (anti-aging agents), and/or pigments, characterized in that the color developer is dodecyl gallate and the melting aid is an ethylene bis fatty acid amide of formula (I), wherein $R_1$ and $R_2$ are $CH_3(CH_2)_mCH_2$ with m=13 and/or 15. The invention further relates to a method for producing said recording material.

(I)

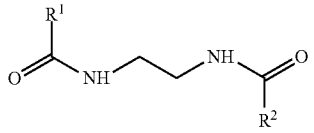

19 Claims, No Drawings

HEAT-SENSITIVE RECORDING MATERIAL

The invention relates to a heat-sensitive recording material, comprising a carrier substrate and at least one heat-sensitive thermal reaction layer, applied to at least one side of the carrier substrate, which layer contains a colour former and a colour developer which react together, developing colour, under the action of heat, and also a melting aid, and also to a method for applying a heat-sensitive thermal reaction layer to a substrate, i.e. the production of such a heat-sensitive recording material.

Heat-sensitive recording materials for direct thermal printing applications with a heat-sensitive thermal reaction layer applied to a carrier substrate have been known for a long time. The heat-sensitive thermal reaction layer usually contains a colour former, a colour developer and if applicable further additives.

The use of gallic acid derivatives as colour developers and leuco dyes as dye precursors in the heat-sensitive thermal reaction layer is also known.

Such recording materials were developed in order to improve responsiveness in thermal printers, even without the aid of melting aids (what are called sensitisers or thermal solvents) (JP 1984-022795), and to increase the fastness of the printed image (JP 1982-176196), especially if the printed recording material comes into contact with hydrophobic substances, such as plasticiser-containing materials or oils (JP 1985-032697, JP 04-307290).

Sometimes these desirable properties are attained only by the use of specific melting aids, such as diaryl carbonates (JP 1987-261479) or oxalic acid esters (JP 1992-062088), or of anti-ageing agents (JP 2005-088458) in combination with gallic acid derivatives.

The use of combinations of gallic acid esters with lactic acid oligomers has also been described (EP 2910384).

This use of gallic acid esters, especially of stearyl and lauryl gallates, results in heat-sensitive recording materials with a relatively low starting temperature of the colour-forming reaction. The starting temperature (static responsiveness) by definition is the lowest temperature at which the colour-forming reaction between the colour former and colour developer leads to discolouration of the recording material. This can be clearly recognised visually and usually corresponds to an image intensity with an optical print density of 0.20 units.

The reason for the low starting temperature may lie, inter alia, in the inherent low melting point of the gallic acid esters, the formation of low-melting hydrates upon wet grinding of the gallic acid esters during production of the coating compounds, or the formation of low-melting eutectic mixtures between the developer substances and further components of the thermal reaction layer.

Low starting temperatures prevent the use of the heat-sensitive recording materials in applications in which the thermally unprinted, white material is exposed to temperatures lying above the starting temperature. For most applications, therefore, a starting temperature of greater than 70° C. is desirable.

Process-wise, a low starting temperature has an adverse effect on the drying of the recording materials after application of the (aqueous) coating compound, since the drying temperature has to be below the starting temperature in order to obtain a desirable, non-greyed, white material. In practical terms, this can be achieved only by a sufficiently long residence time of the moist web in the dry section of the coating plant, which is set to relatively low temperatures.

The necessary residence time is directly proportional to the length of the drying tunnel and inversely proportional to the coating speed.

A low starting point thus has a direct effect on the economic efficiency of the production method and the surface whiteness.

It is an aim of the present invention to address the above-mentioned disadvantages of the prior art. Especially, the aim comprises in making available a heat-sensitive recording material with a high proportion of toxicologically harmless functional chemicals of natural origin in the thermal reaction layer, which material is capable of ensuring important application-specific properties, such as for example low static thermal responsiveness (high starting temperature), while at the same time having high thermal printing sensitivity. Further, it is an aim of the present invention to devise a method for the production of such a heat-sensitive recording material.

The above-mentioned aim is addressed with a heat-sensitive recording material according to Claim 1 which is characterised in that it contains a carrier substrate and at least one heat-sensitive thermal reaction layer applied to at least one side of the carrier substrate, which layer contains at least one fluoran colour former, at least one colour developer, at least one melting aid and optionally usual additives, such as slip additives, stabilisers (anti-ageing agents) and/or pigments, and is characterised in that the colour developer is dodecyl gallate and the melting aid is an ethylene-bis-fatty acid amide of Formula I, (I)

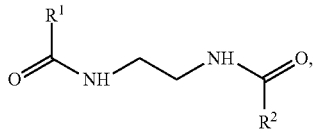

wherein $R^1$ and $R^2$ are $CH_3(CH_2)_mCH_2$ with m=13 and/or 15. The term "comprises" may also mean "consist of". A method for producing the heat-sensitive recording material is described in Claim 11.

The crux of the present invention accordingly lies in providing a heat-sensitive recording material with a heat-sensitive thermal reaction layer which is based on the combination of a fluoran colour former, dodecyl gallate as colour developer and an ethylene-bis-fatty acid amide of Formula I as melting aid.

The heat-sensitive recording material according to the invention exhibits balanced, marketable, application-specific performance features and is based on a colour developer and a melting aid of natural origin with an advantageous human-toxicological and eco-toxicological profile.

Dodecyl Gallate has the Formula II (II)

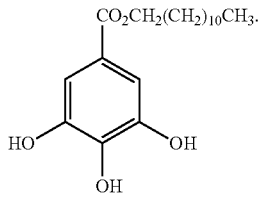

The ethylene-bis-fatty acid amide of Formula I preferably has a melting point of approximately 120° C. to 160° C.

Especially, the melting aid ethylene-bis-fatty acid amides of Formula I comprises the following combinations:

a) $R^1{=}CH_2(CH_2)_{13}CH_3$, (m=13) and $R^2{=}CH_2(CH_2)_{15}CH_3$, (m=15), ($C_{16}/C_{18}$-ethylene-bis-amide, ethylene-N-palmitamide-N'-stearamide), b) $R^1{=}R^2{=}CH_2(CH_2)_{13}CH_3$, (m=13), ($C_{16}/C_{16}$-ethylene-bis-amide, N,N'-ethylene-bis-palmitamide), and c) $R^1{=}R^2{=}CH_2(CH_2)_{15}CH_3$, (m=15), ($C_{18}/C_{18}$-ethylene-bis-amide, N,N'-ethylene-bis-stearamide)

and also mixtures of a), b) and c).

Industrially produced ethylene-bis-fatty acid amides of the general formula I start from fatty acids obtained from natural sources (vegetable or animal oils/fats), so as a rule they contain a mixture of the ethylene-bis-fatty acid amides listed under a), b) and c).

The relative $C_{16}/C_{18}$-, $C_{16}/C_{16}$-, and $C_{18}/C_{18}$-fractions in the product, and thereby also the melting behaviour, can be controlled by suitably selecting the fatty-acid cut and the reaction conditions. Usual impurities of commercial types of ethylene-bis-fatty acid amides are ethylene-bis-fatty acid amides of the type $C_{14}/C_{16}$, $C_{14}/C_{18}$, $C_{18}/C_{20}$ and others.

Surprisingly, it has been shown that the use of ethylene-bis-fatty acid amides results in good dynamic sensitivity in the heat-sensitive recording material especially when the percentage of the ethylene-bis-fatty acid amides listed under a), b) and c) (in total) amounts to at least approximately 80 percent surface area (determined as described below). Such heat-sensitive recording materials also have the desired starting point of above 70° C. Examples of such ethylene-bis-fatty acid amides or ethylene-bis-stearic acid amides (EBS) can be inferred from Table 1 below.

TABLE 1

| Specimens | $C_{16}/C_{18}$-ethylene-bis-amide | $C_{16}/C_{16}$-ethylene-bis-amide | $C_{18}/C_{18}$-ethylene-bis-amide | Total ($C_{16}/C_{16}$-, $C_{16}/C_{18}$-$C_{18}/C_{18}$-) fractions |
|---|---|---|---|---|
| EBS I | 17.3 | 42.4 | 28.8 | 88.5 |
| EBS II | 25.7 | 42.0 | 16.4 | 84.1 |
| EBS III | 18.5 | 40.6 | 26.4 | 85.5 |
| EBS IV | 37.2 | 42.8 | 12.5 | 92.5 |
| EBS V | 39.3 | 41.0 | 10.9 | 91.2 |
| EBS VI | 31.1 | 45.4 | 17.1 | 93.6 |
| EBS VII | 24.7 | 40.7 | 18.3 | 83.7 |
| EBS VIII | 87.9 | 1.2 | 0 | 89.1 |

Without being bound by this theory, the good performance of the heat-sensitive recording material according to the invention might be explained by a sufficiently high solubility (or solubility rate) of the lipophilic gallic ester in the ethylene-bis-fatty acid amides, without low-melting eutectic mixtures forming between the colour developer and the melting aid, with adverse effects on the starting point.

No particular demands are made on the carrier substrate for the heat-sensitive recording material. It is however preferred if the carrier substrate is paper, synthetic paper or a plastics-material film.

Especially preferred fluoran colour formers are for example 3-diethylamino-6-methyl-7-anilinofluoran,
3-(N-ethyl-N-p-toluidinamino)-6-methyl-7-anilinofluoran,
3-(N-ethyl-N-isoamylamino)-6-methyl-7-anilinofluoran,
3-diethylamino-6-methyl-7-(o,p-dimethylanilino)fluoran,
3-pyrrolidino-6-methyl-7-anilinofluoran,
3-(cyclohexyl-N-methylamino)-6-methyl-7-anilinofluoran,
3-diethylamino-7-(m-trifluoromethylanilino)fluoran,
3-N-n-dibutylamino-6-methyl-7-anilinofluoran,
3-diethylamino-6-methyl-7-(m-methylanilino)fluoran,
3-N-n-dibutylamino-7-(o-chloroanilino)fluoran,
3-(N-ethyl-N-tetrahydrofurfurylamino)-6-methyl-7-anilinofluoran,
3-(N-methyl-N-propylamino)-6-methyl-7-anilinofluoran,
3-(N-ethyl-N-ethoxypropylamino)-6-methyl-7-anilinofluoran,
3-(N-ethyl-N-isobutylamino)-6-methyl-7-anilinofluoran, and/or
3-dipentylamino-6-methyl-7-anilinofluoran.

In addition to the ethylene-bis-fatty acid amide of Formula I, further melting aids may be used, provided that they do not have any undesirable effects on the application-specific performance features, such as surface whiteness of the thermal function layer or the starting temperature of the heat-sensitive recording material. For example, primary fatty acid amides, ethers, such as 1,2-diphenoxyethane, 1,2-di-(3-methylphenoxy)ethane, 2-benzyloxynaphthalene, 1,4-diethoxynaphthalene, carboxylic acid esters, such as dibenzyl terephthalate, benzyl-p-(benzyloxy)benzoate, di-(p-methylbenzyl)oxalate, di-(p-chlorobenzyl)oxalate, di-(p-benzyl)oxalate, aromatic sulphones, such as diphenylsulphone, aromatic sulphonamides, such as benzene sulphonanilide, N-benzyl-p-toluenesulphonamide or the like, may be used as further melting aids. There is also the possibility of using mixtures of these further melting aids.

Preferably approximately 0.5 to approximately 10 parts by weight, preferably approximately 1.5 to approximately 4 parts by weight, dodecyl gallate (II) are present, relative to 1 part by weight colour former. Amounts of less than 0.5 parts by weight have the disadvantage that the desired thermal printing sensitivity is not achieved, whereas amounts of more than 10 parts by weight lead to the economic efficiency of the recording material suffering, without achieving any application-specific improvements.

In a further preferred embodiment, 0.5 to 5 parts by weight, especially preferably 0.9 to 2.0, parts ethylene-bis-fatty acid amide of Formula I are used per 1 part by weight dodecyl gallate. A weight ratio of ethylene-bis-fatty acid amide to dodecyl gallate of less than 0.5 or greater than 5 has an adverse effect on the thermal printing sensitivity, be it that the amount of developer present in the melting aid melt is too low or the resulting colour complex undergoes disadvantageous dilution due to the large amount of melting aid.

Further, it is preferred that the colour developer be present in the heat-sensitive thermal reaction layer in an amount of from 3 to 35% by weight, relative to the total solids content of the heat-sensitive thermal reaction layer.

Preferably a binder is present in the heat-sensitive thermal reaction layer.

The binders may for example water-soluble starches, starch derivatives, methylcellulose, hydroxyethylcellulose, carboxymethylcellulose, partially or completely saponified polyvinyl alcohols, chemically modified polyvinyl alcohols or styrene/maleic anhydride copolymers, styrene/butadiene copolymers, acrylamide/(meth)acrylate copolymers, acrylamide/acrylate/methacrylate terpolymers, polyacrylates, poly(meth)acrylic acid esters, acrylate/butadiene copolymers, polyvinyl acetate, acrylonitrile/butadiene copolymers and/or cross-linked biopolymers, such as EcoSphere® (Eco-Synthetix) be used.

Preferably release (anti-adhesion) agents or slip additives may also be present in the heat-sensitive thermal reaction layer, such as for example fatty acid metal salts, e.g. zinc stearate, calcium stearate and/or behenate salts, etc.

Optionally, stabilisers (anti-ageing agents) in the form of sterically hindered phenols, preferably 1,1,3-tris-(2-methyl-4-hydroxy-5-cyclohexylphenyl)-butane (DH-43), 1,1,3-tris-(2-methyl-4-hydroxy-5-tert butylphenyl)-butane (DH-37) and 1,1-bis-(2-methyl-4-hydroxy-5-tert butyl-phenyl)-butane (DH-26), may be present in the heat-sensitive thermal reaction layer.

Also urea-urethane compounds of Formula (III), such as the commercial product UU (urea-urethane), or ethers derived from 4,4'-dihydroxydiphenyl sulphone, such as 4-benzyloxy-4'-(2-methylglycidyloxy)diphenyl sulphone (trade name NTZ-95®, Nippon Soda Co. Ltd.), or oligomeric ethers of the general formula (IV) (trade name D90®, Nippon Soda Co. Ltd.) can be used as stabilisers in the heat-sensitive thermal reaction layer

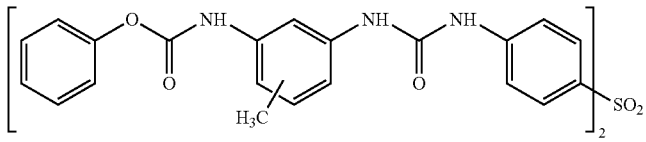

(III)

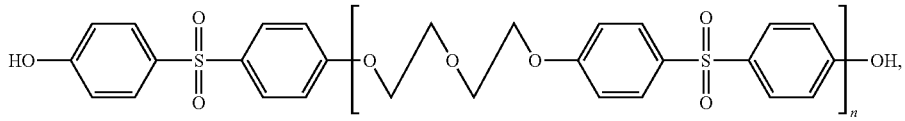

(IV)

with n=1-3.

Preferably pigments, which may perform a large number of functions, are incorporated in the heat-sensitive thermal reaction layer. For example, pigments fix the molten chemicals produced in the thermal printing process on their surface, the surface whiteness and opacity of the recording layer and the printability thereof with conventional printing inks can be controlled by means of pigments, and pigments finally have an "extender function" for the colour-forming functional chemicals, some of which are expensive.

Those pigments which are especially suitable include inorganic pigments, both of synthetic and of natural origin, such as especially clays, precipitated or natural calcium carbonates, aluminium oxides, aluminium hydroxides, silicas, diatomaceous earths, magnesium carbonates, talc, but also organic pigments, such as hollow pigments with a styrene/acrylate copolymer wall and/or urea/formaldehyde condensation polymers.

To control the surface whiteness of the recording material, optionally optical brighteners, preferably those from the stilbenes substance group, can be incorporated into the heat-sensitive thermal reaction layer.

The heat-sensitive recording material according to the invention can be obtained using conventional production methods.

Especially from an economic point of view, it is preferable to produce the heat-sensitive recording material according to the invention as described in claim 11. According to this, an aqueous application suspension containing the starting materials of a thermal reaction layer is applied to a conventional carrier substrate, if applicable with intermediate layers, preferably intermediate pigment layers, formed thereon, and is dried, the aqueous application suspension having a solids content of approximately 20 to 75% by weight and containing as colour developer at least dodecyl gallate and as melting aid at least one ethylene-bis-fatty add amide of Formula I, and the application suspension being applied by means of the curtain coating method at an operating speed of the coating plant of at least approximately 400 m/min, and dried.

The so-called curtain coating method is known to the person skilled in the art and is distinguished by the following criteria:

In the curtain coating method, a freely falling curtain of a coating dispersion is formed. By free falling, the coating dispersion which is present in the form of a thin film (curtain) is "poured" onto a substrate in order to apply the coating dispersion to the substrate. DE 10196052 T1 discloses the use of the curtain coating method in the production of information recording materials, inter alia also of heat-sensitive recording materials, wherein multi-layered recording layers take place by applying the curtain, which comprises a plurality of coating dispersion films, to substrates (speed max. 200 m/min).

If the value of the solids content of the heat-sensitive application suspension is below approximately 20% by weight, then the desired economic efficiency of the method is not sufficiently attained, since an excessively large quantity of water has to be removed from the thermal reaction layer by gentle drying in a short time, which has an adverse effect on the coating speed. If the value of 75% by weight is exceeded, then this does not lead to a considerable improvement, but means only increased technical expense in order to ensure the stability of the coating slip curtain during the coating process.

It has proved especially advantageous if attention is paid to the viscosity of the aqueous application suspension for forming the heat-sensitive thermal reaction layer. For example, it is advantageous if the aqueous deaerated application suspension has a viscosity of approximately 150 to 800 mPas (Brookfield 100 rpm, 20° C.), especially of approximately 200 to 500 mPas.

If this value is below approximately 150 mPas, or the upper limit of 800 mPas is exceeded, then this leads to insufficient runnability of the coating compound at the coating unit.

The economic efficiency of the method according to the invention can be improved by increasing the speed to more than approximately 750 m/min and especially to more than approximately 1000 m/min. It was surprisingly found that even a speed of more than approximately 1500 m/min leads to a non-detrimentally advantageous heat-sensitive recording material without any disadvantages in performing the operation or in the performance features of the heat-sensitive recording material being detectable.

To optimise the method according to the invention, the surface tension of the aqueous application suspension can be set in a suitable manner, preferably to approximately 25 to 60 mN/m and especially preferably to approximately 35 to 50 mN/m (Du Noüy static ring method, DIN 53914).

In order to improve certain coating-specific properties, it is useful in an individual case to include still further constituents in addition to the above-mentioned constituents, especially rheology aids, such as thickeners or surfactants. It is at the discretion of the person skilled in the art to determine the amounts suitable in each case here.

In the context of the method according to the invention, the thermal reaction layer can be formed online, or in a separate coating operation offline. This also applies to any subsequently applied layers or intermediate layers.

In general it is advantageous if the dried heat-sensitive thermal reaction layer is subjected to a smoothing measure. In this case it is advantageous to set the Bekk smoothness, measured to ISO 5627, to approximately 100 to 1200 sec, especially to approximately 300 to 700 sec.

The embodiments which are preferred in conjunction with the heat-sensitive recording material likewise apply to the method according to the invention.

The advantages associated with the present invention can be summarised essentially as follows:

The functional chemicals underlying the heat-sensitive recording material according to the invention are predominantly of natural origin. The heat-sensitive recording material according to the invention when used exhibits desirable application-specific properties, especially good dynamic responsiveness in thermal printers, with a simultaneously high starting temperature. This permits an extremely high level of operation of the coating plant at a speed of up to more than approximately 1500 m/min, which is advantageous from an economic point of view, without relevant adverse effects on the desired properties of the heat-sensitive recording material according to the invention occurring.

The invention will now be illustrated in detail below with reference to non-restrictive examples:

EXAMPLES

An aqueous application suspension was applied on a laboratory scale by means of a rod blade on the coated side of a thin pre-coated paper of 50 g/m$^2$ to form the thermal reaction layer of a heat-sensitive recording paper. It was dried with hot air (hairdryer), and a thermal recording sheet was obtained. The application amount of the heat-sensitive layer was between 4.0 and 4.5 g/m$^2$. The pre-coated paper is a wood-free paper with a weight of 43 g/m$^2$, to which was applied an aqueous coating compound, consisting of 100 parts calcined kaolin (Ansilex from BASF), 20 parts of a 50% styrene/butadiene copolymer emulsion and 125 parts water, with a dry application of 7 g/m$^2$ by means of a doctor bar in order to form an intermediate layer.

On a production scale, the aqueous heat-sensitive application suspension was applied to a paper provided with an intermediate layer (see above), of a base weight of 50 g/m$^2$ by means of the curtain coating method.

The viscosity of the aqueous application suspension was 450 mPas (according to Brookfield, 100 rpm, 20° C.) (in the deaerated state). The surface tension thereof was 46 mN/m (static ring method). The coating apparatus was arranged inline. The curtain coating method was operated at a speed of 1250 m/min.

Using the particulars given above, a heat-sensitive recording material or thermal paper was produced, with the following formulations of aqueous application suspensions being used to form a composite structure on a carrier substrate and then the further layers, especially a protective layer, being formed in conventional manner: this will not be discussed separately here, since the core of the invention is not affected thereby.

Formulation 1

An aqueous application suspension was produced by thoroughly mixing an aqueous dispersion of the colour former which was produced by grinding 19 parts of a colour former (FBB) with 34 parts of a 15% aqueous solution of Ghosenex™ L-3266 (sulphonated polyvinyl alcohol, Nippon Ghosei) in a bead mill, an aqueous colour developer dispersion which was produced by grinding 17.5 parts gallic acid ester together with 16 parts of the melting aid and with 54 parts of a 15%-strength aqueous solution of Ghosenex™ L-3266 in a bead mill, 140 parts of a 56%-strength PCC dispersion (precipitated calcium carbonate, Precarb®, Schaefer Kalk), 40 parts of an aqueous 20%-strength zinc stearate dispersion, 50 parts of a 10%-strength aqueous polyvinyl alcohol solution (Mowiol 28-99, Kuraray Europe) and 1 part of a 31% aqueous solution of the optical brightener Blankophor® PT.

The heat-sensitive coating suspensions thus obtained, which can be seen from Table 2, were set to a solids content of 30% in each case with 153 parts water, and used to produce a composite structure of paper carrier and thermal reaction layer.

Formulation 2

An aqueous application suspension was produced by thoroughly mixing an aqueous dispersion of the colour former which was produced by grinding 14.2 parts FBB I with 25.4 parts of a 15% aqueous solution of Ghosenex™ L-3266 (sulphonated polyvinyl alcohol, Nippon Ghosei) in a bead mill, an aqueous dispersion which was produced by grinding 4.8 parts FBB II with 8.6 parts of a 15% aqueous solution of Ghosenex™ L-3266 (sulphonated polyvinyl alcohol, Nippon Ghosei) in a bead mill, an aqueous colour developer dispersion which was produced by grinding 17.5 parts of gallic acid ester together with 16 parts of the melting aid and with 55 parts of a 15%-strength aqueous solution of Ghosenex™ L-3266 in a bead mill, 140 parts of a 56%-strength PCC dispersion (precipitated calcium carbonate, Precarb®, Schaefer Kalk), 40 parts of an aqueous 20%-strength zinc stearate dispersion, 50 parts of a 10%-strength aqueous polyvinyl alcohol solution (Mowiol 28-99, Kuraray Europe) and 1 part of an aqueous solution of the optical brightener Blankophor® PT.

The heat-sensitive coating suspension thus obtained, which can be seen from Table 2, was set to a solids content of 30% in each case with 153 parts water, and used to produce a composite structure of paper support and thermal reaction layer.

Formulation 3

An aqueous dispersion of the anti-ageing agent, which was produced by grinding 6 parts anti-ageing agent with 11.7 parts of a 15%-strength aqueous solution of Ghosenex™ L-3266 (sulphonated polyvinyl alcohol, Nippon Ghosei) in a bead mill, was admixed to 524.5 parts of the application suspension produced according to Formulation 1, and the mixture was homogenised well by stirring.

The heat-sensitive coating suspensions thus obtained, which can be seen from Table 2, were set to a solids content of 30% in each case with 8 parts water, and used to produce a composite structure of paper support and thermal reaction layer.

Formulation 4

An aqueous dispersion of the anti-ageing agent, which was produced by grinding 6 parts anti-ageing agent with 11.7 parts of a 15% aqueous solution of Ghosenex™ L-3266 (sulphonated polyvinyl alcohol, Nippon Ghosei) in a bead mill, was admixed to 525.5 parts of the application suspension produced according to Formulation 2, and the mixture was homogenised well by stirring.

The heat-sensitive coating suspension thus obtained, which can be seen from Table 2, was set to a solids content of 30% in each case with 7 parts water, and used to produce a composite structure of paper support and thermal reaction layer.

Formulation 5a

In Formulation 2, 109 parts of a 72%-strength coating kaolin dispersion (Lustra® S from BASF) were used instead of the PCC dispersion.

The heat-sensitive coating suspension thus obtained, which can be seen from Table 2, was set to a solids content of 30% with 185 parts water, and used to produce a composite structure of paper support and thermal reaction layer.

Formulation 5b

In Formulation 2, 140 parts of a 56%-strength aluminium hydroxide dispersion (Martifin® OL from Albermarle) were used instead of the PCC dispersion.

The heat-sensitive coating suspension thus obtained, which can be seen from Table 2, was set to a solids content of 30% with 153 parts water, and used to produce a composite structure of paper support and thermal reaction layer.

Formulation 5c

In Formulation 2, 109 parts of a pigment dispersion, which had been obtained by stirring 15.5 parts of an amorphous precipitated silica (Sipernat® from Evonik) into 110 parts of a 56%-strength PCC dispersion (precipitated calcium carbonate, Precarb®, Schaefer Kalk), was used instead of the PCC dispersion.

The heat-sensitive coating suspension thus obtained, which can be seen from Table 2, was set to a solids content of 30% with 163 parts water, and used to produce a composite structure of paper support and thermal reaction layer.

Formulation 5d

In Formulation 2, 109 parts of a pigment dispersion, which had been obtained by stirring 15.5 parts of an amorphous precipitated silica (Sipernat® from Evonik) into 110 parts of a 56%-strength aluminium hydroxide dispersion (Martifin® OL from Albermarle), was used instead of the PCC dispersion.

The heat-sensitive coating suspension thus obtained, which can be seen from Table 2, was set to a solids content of 30% with 163 parts water, and used to produce a composite structure of paper support and thermal reaction layer.

Formulation 5e

In Formulation 2, 109 parts of a pigment dispersion, which had been obtained by stirring 15.5 parts of an amorphous precipitated silica (Sipernat® from Evonik) into 86 parts of a 72%-strength coating kaolin dispersion (Lustra® S from BASF), was used instead of the PCC dispersion.

The heat-sensitive coating suspension thus obtained, which can be seen from Table 2, was set to a solids content of 30% with 188 parts water, and used to produce a composite structure of paper support and thermal reaction layer.

The grain size (D4.3 value in μm) of the ground functional chemicals was set to 1.0±0.1 μm. The grain-size distribution was measured by laser diffraction with a Coulter LS230 apparatus from Beckman Coulter.

The thermal recording materials according to Table 2 were evaluated as described below.

(1) Dynamic Colour Density

The papers (strips 6 cm wide) were thermally printed with a checkerboard pattern with 10 energy gradations using the Atlantek 200 test printer (from Atlantek, USA) with a Kyocera print head of 200 dpi and 560 ohm at an applied voltage of 20.6 V and a maximum pulse width of 0.8 ms. The image density (optical density, o. d.) was measured with a Macbeth densitometer RD-914 from Gretag.

(2) Static Colour Density (Starting Temperature):

The recording sheet was pressed against a row of thermostatically controlled metal punches heated to different temperatures with a pressure of 0.2 kg/cm$^2$ and a contact time of 5 sec (thermal tester TP 3000QM, Maschinenfabrik Hans Rychiger AG, Steffisburg, Switzerland). The image density (opt. density) of the images thus produced was measured with a Macbeth densitometer RD-914 from Gretag. The static starting point by definition is the lowest temperature at which an optical density of 0.2 is achieved.

(3) Fastness of the Printed Image Under Conditions of Artificial Ageing:

One specimen of the thermal recording paper in each case, dynamically recorded in accordance with the method of (1), was stored for 7 days under the following conditions:

50° C. (dry ageing),

40° C., 85% relative humidity (wet ageing) and artificial light from fluorescent tubes, illumination intensity 16000 lux (light fastness).

Once the test period had elapsed, the image density (o. d.) was measured and related to the corresponding image density values before the artificial ageing in accordance with Formula (V).

$$\%\ \text{change in } o.d. = \left(\frac{\text{image density after ageing}}{\text{image density before ageing}} - 1\right) \times 100 \quad \text{(V)}$$

The constituents of the EBS samples were quantified after GC separation and FID detection.

Percentages of surface area were calculated using the integration region underlying the solvent peak (from a retention time of 5 min. onwards).

0.2 μl of a 0.05% by weight o-xylene solutions of the EBS specimens were injected splitless.

GC conditions:

Injector temperature: 360° C.

Separating column Varian CP 7491, 15 max 0.32 mm ID, column flow 1.5 ml/min

Carrier gas: He

Temperature program: 100° C. for 2 min., 20° C. per min. up to 250° C., 10° C. per min. up to 360° C.

Detector temperature 370° C.

Chemical assignment took place by means of GC-MS coupling.

TABLE 2

Assignment of the paper samples to the formulations of the heat-sensitive coating

| Sample | Formulation | Colour former* I | Colour former* II | Colour developer | Melting aid ** | Anti-ageing | Pigment *** |
|---|---|---|---|---|---|---|---|
| 1 | 1 | ODB-2 | — | Dodecyl gallate | EBS I | — | PCC |
| 2 | 1 | ODB-2 | — | Dodecyl gallate | EBS II | — | PCC |
| 3 | 1 | ODB-2 | — | Dodecyl gallate | EBS III | — | PCC |
| 4 | 1 | ODB-2 | — | Dodecyl gallate | EBS IV | — | PCC |
| 5 | 1 | ODB-2 | — | Dodecyl gallate | EBS V | — | PCC |
| 6 | 1 | ODB-2 | — | Dodecyl gallate | EBS VI | — | PCC |
| 7 | 1 | ODB-2 | — | Dodecyl gallate | EBS VII | — | PCC |
| 8 | 1 | ODB-2 | — | Dodecyl gallate | EBS VIII | — | PCC |
| 9 | 2 | ODB-2 | S205 | Dodecyl gallate | EBS I | — | PCC |
| 10 | 3 | ODB-2 | — | Dodecyl gallate | EBS I | DH-43 | PCC |
| 11 | 4 | ODB-2 | S205 | Dodecyl gallate | EBS I | DH-43 | PCC |
| 12 | 3 | ODB-2 | — | Dodecyl gallate | EBS I | UU | PCC |
| 13 | 4 | ODB-2 | S205 | Dodecyl gallate | EBS I | UU | PCC |
| 14 | 3 | ODB-2 | S205 | Dodecyl gallate | EBS I | DH-37 | PCC |
| 15 | 4 | ODB-2 | S205 | Dodecyl gallate | EBS I | DH-43 | PCC |
| 16 | 5c | ODB-2 | S205 | Dodecyl gallate | EBS I | — | PCC: silica |
| 17 | 5a | ODB-2 | S205 | Dodecyl gallate | EBS I | — | Clay |
| 18 | 5e | ODB-2 | S205 | Dodecyl gallate | EBS I | — | Clay: silica |
| 19 | 5b | ODB-2 | S205 | Dodecyl gallate | EBS I | — | $Al(OH)_3$ |
| 20 | 5d | ODB-2 | S205 | Dodecyl gallate | EBS I | — | $Al(OH)_3$: silica |
| V1 | 1 | ODB-2 | — | Methyl gallate | EBS I | — | PCC |
| V2 | 1 | ODB-2 | — | Ethyl gallate | EBS I | — | PCC |
| V3 | 1 | ODB-2 | — | Propyl gallate | EBS I | — | PCC |
| V4 | 1 | ODB-2 | — | Octyl gallate | EBS I | — | PCC |
| V5 | 1 | ODB-2 | — | Stearyl gallate | EBS I | — | PCC |
| V6 | 1 | ODB-2 | — | Dodecyl gallate | Stearamide | — | PCC |
| V7 | 1 | ODB-2 | — | Dodecyl gallate | N-methylolstearamide | — | PCC |
| V8 | 1 | ODB-2 | — | Dodecyl gallate | Behenamide | — | PCC |
| V9 | 1 | ODB-2 | — | Dodecyl gallate | Erucamide | — | PCC |
| V10 | 1 | ODB-2 | — | Dodecyl gallate | Ethylene-bis-oleamide | — | PCC |

*S205 = 3-(N-ethyl-N-isoamylamino)-6-methyl-7-anilinofluoran, ODB-2 = 3-N-n-dibutylamino-6-methyl-7-anilinofluoran

** see Table 1

*** PCC = precipitated $CaCO_3$

Table 3 summarises the results of the application-specific paper tests.

TABLE 3

Results of the application–specific paper tests

| Sample | Max. o.d. | Static starting point (° C.) | Artificial ageing dry | Artificial ageing moist | Artificial ageing light |
|---|---|---|---|---|---|
| 1 | 1.15 | 77 | −28 | −37 | −43 |
| 2 | 1.16 | 77 | −15 | −19 | −43 |
| 3 | 1.15 | 75 | −7 | −31 | 34 |
| 4 | 1.17 | 77 | −12 | −20 | −34 |
| 5 | 1.16 | 77 | −10 | −20 | −38 |
| 6 | 1.16 | 77 | −18 | −19 | −37 |
| 7 | 1.16 | 76 | −16 | −19 | −38 |
| 8 | 1.15 | 77 | −13 | −22 | −40 |
| 9 | 1.14 | 72 | −5 | −19 | −37 |
| 10 | 1.15 | 75 | −3 | −18 | −33 |
| 11 | 1.16 | 73 | −3 | −15 | −32 |
| 12 | 1.16 | 77 | −1 | −12 | −31 |
| 13 | 1.18 | 76 | 0 | −11 | −34 |
| 14 | 1.18 | 75 | −2 | −13 | −33 |
| 15 | 1.16 | 75 | −2 | −10 | −31 |
| 16 | 1.21 | 74 | −19 | −31 | −44 |
| 17 | 1.16 | 72 | −15 | −34 | −36 |
| 18 | 1.20 | 74 | −18 | −36 | −43 |
| 19 | 1.13 | 74 | −20 | −33 | −41 |
| 20 | 1.21 | 75 | −26 | −36 | −42 |
| V1 | 0.98 | 79 | −15 | −47 | −45 |
| V2 | 0.83 | 112 | −14 | −38 | −42 |
| V3 | 1.20 | <60 | −6 | −40 | −42 |
| V4 | 1.23 | <60 | −15 | −29 | −42 |
| V5 | 0.92 | 79 | −43 | −51 | −38 |
| V6 | 1.05 | 70 | −32 | −46 | −51 |

TABLE 3-continued

Results of the application–specific paper tests

| Sample | Max. o.d. | Static starting point (° C.) | Artificial ageing dry | Artificial ageing moist | Artificial ageing light |
|---|---|---|---|---|---|
| V7 | 1.05 | 74 | −44 | −51 | −48 |
| V8 | 1.13 | 69 | −31 | −48 | −35 |
| V9 | 1.14 | <60 | −75 | −81 | −58 |
| V10 | 1.04 | <60 | −46 | −58 | −51 |

The heat-sensitive recording material according to the invention has the following advantageous properties:

(1) The heat-sensitive recording materials according to the invention (samples 1 to 8) simultaneously exhibit a significantly higher responsiveness in thermal printers (o. d. 1.15 to 1.17) and a higher starting temperature (75 to 77° C.) compared with the comparison samples with alternative gallic add esters (samples V1-V5) or with other melting aids of natural origin, such as primary fatty acid amides or alternative ethylene-bis-amides (samples V6 to V10).

(2) Using colour former mixtures in the heat-sensitive recording materials according to the invention does not have any adverse effects on the high starting temperature and the high thermal printing sensitivity, regardless of whether formulations without (sample 9) or with anti-ageing agent (samples 11, 13, 14 and 15) are used, and contribute substantially to improving the image fastness, as proved by the artificial ageing values.

(3) It is likewise advantageously possible to use anti-ageing agent in combination with only one colour former (samples 10, 12).

(4) The combination of fluoran colour former, dodecyl gallate and melting aid of Formula I is compatible with a very wide variety of pigments without the properties suffering (samples 16 to 20). This possibility is advantageous especially for controlling further application-specific properties of the heat-sensitive recording material according to the invention, such as whiteness, gloss, receptivity and fixing capacity for inks, prevention of deposits on the print head during thermal printing, abrasiveness, etc.

(5) Owing to the high starting point, the coating-specific window is sufficiently large to be able to produce a recording material with good surface whiteness and low moisture content even at high coating speeds.

The invention claimed is:

1. A heat-sensitive recording material, comprising a carrier substrate and at least one heat-sensitive thermal reaction layer applied to at least one side of the carrier substrate, which layer contains at least one fluoran colour former, at least one colour developer, at least one melting aid and optionally a slip additive, a stabiliser, an anti-ageing agent, and/or a pigment, wherein the colour developer is dodecyl gallate and the melting aid is an ethylene-bis-fatty acid amide of Formula I, (I)

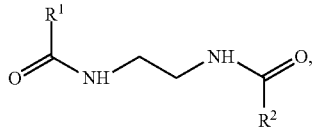

wherein $R^1$ and $R^2$ are $CH_3(CH_2)_mCH_2$ with m=13 and/or 15, and wherein 1.5 to 4 parts by weight dodecyl gallate are used per 1 part by weight fluoran colour former;

and wherein the melting aid has from 83.7 to 93.6 percent surface area of $C_{15}/C_{18}$, $C_{16}/C_{16}$, or $C_{18}/C_{18}$ ethylene-bis-fatty acid amides and combinations thereof relative to the total of all ethylene-bis-fatty acid amides present and wherein the $C_{16}/C_{18}$, $C_{16}/C_{16}$, or $C_{18}/C_{18}$ ethylene-bis-fatty acid amides are:

a) $R^1=CH_2(CH_2)_{13}CH_3$, (m=13) and $R^2=CH_2$ $(CH_2)_{15}CH_3$, (m=15), ($C_{16}/C_{18}$-ethylene-bis-amide, ethylene-N-palmitamide-N1-steramide), b) $R^1=R^2=CH_2(CH_2)_{13}CH_3$, (m=13), ($C_{16}/C_{16}$-ethylene-Ns-amide, N,N1-ethylene-bis-palmitamide), and c) $R_1=R_2=CH_2(CH_2)_{15}CH_3$, (m=15), ($C_{18}/C_{18}$-ethylene-Ns-amide, N,N1-ethylene-bis-steramide), respectively.

2. A heat-sensitive recording material according to claim 1, wherein the at least one fluoran colour former is selected from the group 3-diethylamino-6-methyl-7-anilinofluoran, 3-(N-ethyl-N-p-toluidinamino)-6-methyl-7-anilinofluoran, 3-(N-ethyl-N-isoamylamino)-6-methyl-7-anilinofluoran, 3-diethylamino-6-methyl-7-(o,p-dimethylanilino)fluoran, 3-pyrrolidino-6-methyl-7-anilinofluoran, 3-(cyclohexyl-N-methylamino)-6-methyl-7-anilinofluoran, 3-diethylamino-7-(m-trifluoromethylanilino)fluoran, 3-N-n-dibutylamino-6-methyl-7-anilinofluoran, 3-diethylamino-6-methyl-7-(m-methylanilino)fluoran, 3-N-n-dibutylamino-7-(o-chloroanilino)fluoran, 3-(N-ethyl-N-tetrahydrofurfurylamino)-6-methyl-7-anilinofluoran, 3-(N-methyl-N-propylamino)-6-methyl-7-anilinofluoran, 3-(N-ethyl-N-ethoxypropylamino)-6-methyl-7-anilinofluoran, 3-(N-ethyl-N-isobutylamino)-6-methyl-7-anilinofluoran, and/or 3-dipentylamino-6-methyl-7-anilinofluoran.

3. A heat-sensitive recording material according to claim 1, wherein 0.5 to 5 parts by weight ethylene-bis-fatty acid amide of Formula I are used per 1 part by weight dodecyl gallate.

4. A heat-sensitive recording material according to claim 1, wherein the colour developer is present in an amount of from 3 to 35% by weight, relative to the total solids content of the heat-sensitive thermal reaction layer.

5. A heat-sensitive recording material according to claim 1, wherein the stabiliser is used in the form of sterically hindered phenols, 1,1,3-tris-(2-methyl-4-hydroxy-5-cyclohexylphenyl)-butane, 1,1,3-tris-(2-methyl-4-hydroxy-5-tert butylphenyl)-butane, 1,1-bis-(2-methyl-4-hydroxy-5-tert butyl-phenyl)-butane, urea-urethane compounds of the general formula III, (III)

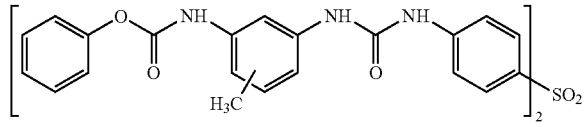

or oligomeric ethers of the general formula IV, (IV)

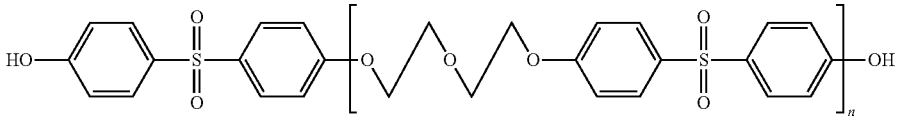

where n=1-3.

6. A heat-sensitive recording material according to claim 1, wherein precipitated calcium carbonate, aluminium hydroxide, kaolins, precipitated silicas or mixtures thereof are used as the pigment.

7. A heat-sensitive recording material according to claim 1, wherein paper, synthetic paper or plastics-material film, optionally with intermediate layers formed thereon, is used as the carrier substrate.

8. A heat-sensitive recording material according to claim 1, wherein the fluoran colour former comprises ODB-2.

9. A method for producing the heat-sensitive recording material of claim 1 comprising applying an aqueous application suspension containing at least one fluoran color former, at least one color developer, and at least one melting aid to a carrier substrate using a curtain coating method, optionally with intermediate layers formed thereon, and drying, the aqueous application suspension having a solids content of approximately 20 to 75% by weight, containing as the colour developer dodecyl gallate and as the melting aid an ethylene-bis-fatty acid amide of Formula I,

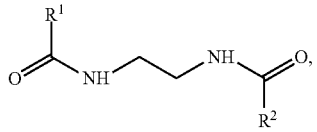

(I)

wherein $R^1$ and $R^2$ are $CH_3(CH_2)_mCH_2$ with m=13 and/or 15, the aqueous application suspension being applied using the curtain coating method at an operating speed of at least approximately 400 m/min.

10. A method according to claim 9, wherein the curtain coating method is operated at a speed of at least approximately 1000 m/min.

11. A method according to claim 9, further comprising forming a layer on the thermal reaction layer online or offline as a protective layer and/or a layer which promotes printability.

12. A method according to claim 9, further comprising forming a layer on a side of the carrier substrate opposite the thermal reaction layer online or offline as a barrier layer and/or a layer which promotes printability.

13. A method according to claim 10, wherein the curtain coating method is operated at a speed of at least approximately 1500 m/min.

14. A heat-sensitive recording material, comprising a carrier substrate and at least one heat-sensitive thermal reaction layer applied to at least one side of the carrier substrate, which layer contains at least one fluoran colour former, at least one colour developer, at least one melting aid and optionally a slip additive, a stabiliser, an anti-ageing agent, and/or a pigment, wherein the colour developer is dodecyl gallate and the melting aid is an ethylene-bis-fatty acid amide of Formula I,

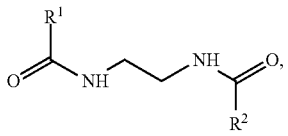

(I)

wherein $R^1$ and $R^2$ are $CH_3(CH_2)_mCH_2$ with m=13 and/or 15 and wherein the colour developer is present in an amount of from 3 to 35% by weight relative to the total solids content of the heat-sensitive thermal reaction layer, wherein 1.5 to 4 parts by weight dodecyl gallate are used per 1 part by weight fluoran colour former;

and wherein the melting aid has from 83.7 to 93.6 percent surface area of $C_{16}/C_{18}$, $C_{16}/C_{16}$, or $C_{18}/C_{18}$ ethylene-bis-fatty acid amides and combinations thereof relative to the total of all ethylene-bis-fatty acid amides present and wherein the $C_{16}/C_{18}$, $C_{16}/C_{16}$, or $C_{18}/C_{18}$ ethylene-bis-fatty acid amides are:

a) $R^1=CH_2(CH_2)_{13}CH_3$, (m=13) and $R^2=CH_2\ (CH_2)_{15}CH_3$, (m=15), ($C_{16}/C_{18}$-ethylene-bis-amide, ethylene-N-palmitamide-N1-steramide), b) $R^1=R^2=CH_2(CH_2)_{13}CH_3$, (m=13), ($C_{16}/C_{16}$-ethylene-bis-amide, N,N1-ethylene-bis-palmitamide), and c) $R_1=R_2=CH_2(CH_2)_{15}CH_3$, (m=15), ($C_{18}/C_{18}$-ethylene-bis-amide, N,N1-ethylene-bis-steramide), respectively.

15. A heat-sensitive recording material according to claim 14, wherein 0.5 to 5 parts by weight ethylene-bis-fatty acid amide of Formula I are used per 1 part by weight dodecyl gallate.

16. A heat-sensitive recording material according to claim 14, wherein the stabiliser is used in the form of sterically hindered phenols, 1,1,3-tris-(2-methyl-4-hydroxy-5-cyclohexylphenyl)-butane, 1,1,3-tris-(2-methyl-4-hydroxy-5-tert butylphenyl)-butane, 1,1-bis-(2-methyl-4-hydroxy-5-tert butyl-phenyl)-butane, urea-urethane compounds of the general formula III,

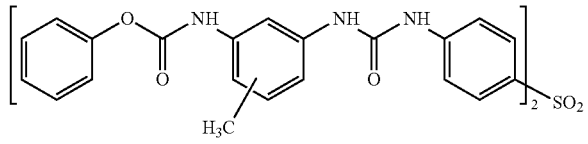

(III)

or oligomeric ethers of the general formula IV,

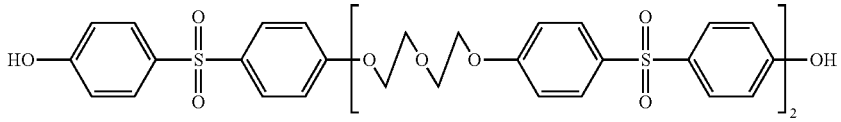

(IV)

where n=1-3.

17. A heat-sensitive recording material according to claim 14, wherein the fluoran colour former comprises ODB-2.

18. A heat-sensitive recording material according to claim 14 comprising at least two ethylene-bis-stearic acid amides.

19. A heat-sensitive recording material according to claim 14, wherein a total EBS fraction is 88.5, 84.1, 85.5, 92.5, 91.2, 93.6, 83.7 or 89.1.

* * * * *